US007617955B2

(12) United States Patent
Riney

(10) Patent No.: US 7,617,955 B2
(45) Date of Patent: Nov. 17, 2009

(54) METHOD AND SYSTEM FOR DISPENSING LIQUID FROM A MODULE HAVING A FLEXIBLE BELLOWS SEAL

(75) Inventor: John M. Riney, Buford, GA (US)

(73) Assignee: Nordson Corporation, Westlake, OH (US)

( * ) Notice: Subject to any disclaimer, the term of this patent is extended or adjusted under 35 U.S.C. 154(b) by 506 days.

(21) Appl. No.: 10/975,229

(22) Filed: Oct. 28, 2004

(65) Prior Publication Data

US 2006/0097015 A1 May 11, 2006

(51) Int. Cl.
*B67D 3/00* (2006.01)

(52) U.S. Cl. ..... 222/559; 222/504; 222/509; 222/510; 222/518; 251/214; 251/335.1

(58) Field of Classification Search ..... 222/504, 222/559, 518, 505, 509, 510, 542; 277/628, 277/630, 637, 641; 251/214, 318, 331, 335.1, 251/335.2, 335.3

See application file for complete search history.

(56) References Cited

U.S. PATENT DOCUMENTS 3,759,425 A 9/1973 Lee
3,982,724 A 9/1976 Citrin
4,066,188 A 1/1978 Scholl et al.
4,126,321 A 11/1978 Harjar et al.
4,359,204 A * 11/1982 Williams ..... 251/331
4,583,662 A 4/1986 Silverthorn et al.
4,651,906 A 3/1987 Hoffmann et al.
5,114,055 A * 5/1992 Worth ..... 222/542
5,152,500 A * 10/1992 Hoobyar et al. ..... 251/269
5,244,152 A 9/1993 Hofmann
5,292,068 A 3/1994 Raterman et al.

(Continued)

FOREIGN PATENT DOCUMENTS

DE 3153338 6/1989

(Continued)

OTHER PUBLICATIONS

EFD, Piston Valve Systems for Precise Deposits of Viscous Fluids, Brochure, 2006, 2 pgs.

(Continued)

*Primary Examiner*—J. Casimer Jacyna
(74) *Attorney, Agent, or Firm*—Wood, Herron & Evans, L.L.P.

(57) ABSTRACT

A dispensing module for dispensing liquid includes a dispensing body having an inlet, a discharge outlet, and a flow channel therebetween having a valve seat. A needle having a valve element is mounted to the body and reciprocates therein between an open position, in which the valve element is disengaged from the valve seat thereby allowing liquid flow, and a closed position, in which the valve element is engaged with the valve seat thereby preventing liquid flow. A needle guide is mounted to the dispenser body and includes a passage for receiving a portion of the needle. A flexible seal includes a first end coupled to the needle guide and a second end coupled to the needle and moving therewith. An actuator is operatively coupled to the needle and moves the needle between the open and closed positions. The seal includes a central portion with an interior cavity that stretches and compresses as the needle reciprocates.

20 Claims, 2 Drawing Sheets

U.S. PATENT DOCUMENTS

| | | | | |
|---|---|---|---|---|
| 5,447,254 | A | 9/1995 | Hoover et al. | |
| 5,535,919 | A | 7/1996 | Ganzer et al. | |
| 5,598,974 | A | 2/1997 | Lewis et al. | |
| 5,630,444 | A * | 5/1997 | Callaghan et al. | 137/550 |
| 5,645,224 | A | 7/1997 | Koch | |
| 5,678,803 | A * | 10/1997 | Shinohara et al. | 251/368 |
| 5,794,825 | A | 8/1998 | Gordon et al. | |
| 5,853,124 | A | 12/1998 | Beck et al. | |
| 5,899,385 | A | 5/1999 | Hofmann et al. | |
| 5,957,343 | A | 9/1999 | Cavallaro | |
| 6,056,155 | A | 5/2000 | Byerly et al. | |
| 6,253,957 | B1 | 7/2001 | Messerly et al. | |
| 6,334,554 | B1 | 1/2002 | Bolyard, Jr. et al. | |
| 6,343,721 | B1 * | 2/2002 | Breault | 222/399 |
| 6,648,006 | B1 * | 11/2003 | Ostergaard | 137/241 |
| 6,712,366 | B1 * | 3/2004 | Cargill | 277/641 |
| 6,799,702 | B1 | 10/2004 | Mercer et al. | |
| 2005/0224513 | A1 | 10/2005 | Strong et al. | |
| 2005/0236438 | A1 | 10/2005 | Chastine et al. | |
| 2006/0108383 | A1 | 5/2006 | Byerly | |
| 2006/0124672 | A1 * | 6/2006 | Penalver | 222/504 |

FOREIGN PATENT DOCUMENTS

| | | |
|---|---|---|
| DE | 3812384 | 10/1989 |
| DE | 4122594 | 11/1992 |
| DE | 10046326 | 4/2002 |

OTHER PUBLICATIONS

EFD, Compact Diaphragm Valve for Fine Flow Control, Brochure, 2006, 2 pgs.

Joseph A. Kaufman (Examiner); Office Action issued in related U.S. Appl. No. 10/904,662; dated as mailed on Dec. 7, 2006; 8 pgs.; USPTO.

Joseph A. Kaufman (Examiner); Final Office Action issued in related U.S. Appl. No. 10/904,662; dated May 14, 2007; 12 pgs.; USPTO.

* cited by examiner

METHOD AND SYSTEM FOR DISPENSING LIQUID FROM A MODULE HAVING A FLEXIBLE BELLOWS SEAL

FIELD OF THE INVENTION

This invention generally relates to liquid dispensing devices used for a variety of purposes, but particularly useful for viscous liquids such as hot melt adhesives, sealing compounds, paints, etc. Such devices are referred to as fluid control valves or dispensing guns or modules.

BACKGROUND OF THE INVENTION

A typical dispensing device for supplying liquid, such as hot melt adhesive, generally includes a body having a valve stem that opens and closes a dispensing orifice. The valve stem is usually actuated in at least one direction by pressurized air to dispense discrete amounts of pressurized liquid. Either a spring mechanism or pressurized air is used to move the valve stem in an opposite direction against a valve seat. This stops the flow of liquid from the dispensing orifice.

More specifically, devices generally related to the present invention include a liquid passage adjacent the dispensing orifice and an actuator cavity or chamber at an opposite end of the device. The actuator cavity contains a portion of the valve stem which is connected with a piston member and which is also connected with a spring return mechanism, as discussed above. Under sufficient air pressure applied on one side of the piston member, the valve stem is moved in a direction away from the valve seat to discharge liquid. When the air pressure is relieved, the spring mechanism will automatically return the valve stem to a normally closed position against the valve seat. Such spring mechanisms generally include an adjustment to vary the spring compression and thereby vary the amount of air pressure required to open the valve. Adjustment of the spring compression will also adjust the biasing force used to close the valve. These devices also include a stroke adjustment, or the spring compression adjustment also varies the stroke of the valve stem to adjust the flow rate.

Despite the wide success of devices as described above, improvement is desired. For example, a dynamic seal placed generally between the dispenser body and the moving valve stem typically prevents liquid from leaking into the actuator cavity. Dynamic seals are conventionally understood to be seals between two surfaces that move relative to one another. These dynamic seals may press tightly against the valve stem and cause friction and seal wear. The higher friction may place greater demands on the requirements for pressurized air to move the valve stem. On the other hand, selecting a looser dynamic seal could result in inadequate sealing, thus allowing the liquid to bind the piston and pressurized air to enter into the liquid passage, causing undesired dispensing discontinuities. Even with reduced friction, the dynamic seal will wear over time and lose its ability to seal properly.

It would therefore be desirable to provide a dispensing method and dispenser device that eliminates or reduces the need for dynamic seals in contact with the pressurized liquid, thus eliminating or reducing problems such as those mentioned above.

SUMMARY OF THE INVENTION

The invention addresses these and other drawbacks associated with the prior art by providing a dispensing module including a dispenser or module body having a liquid inlet, a discharge outlet, and a flow channel capable of directing a flow of liquid from the liquid inlet to the discharge outlet. The flow channel includes a valve seat between the liquid inlet and discharge outlet. A needle having a valve element is mounted to the dispenser body and adapted to reciprocate between an open position, in which the valve element is disengaged with the valve seat thereby allowing liquid flow from the discharge outlet, and a closed position, in which the valve element is engaged with the valve seat thereby preventing liquid flow from the discharge outlet.

The dispensing module further includes a needle guide mounted to the dispenser body and includes a passage for receiving a portion of the needle. The needle moves relative to the needle guide between the open and closed positions. To prevent liquid from leaking out of the flow channel, the module includes a flexible seal having a first and second end with the first end coupled to the needle guide and the second end coupled to the needle. The second end is adapted to move with the needle as it reciprocates. The module also includes an actuator that is operatively coupled to the needle and capable of actuating the needle between the open and closed positions to selectively dispense liquid from the discharge outlet.

In one exemplary embodiment, the seal includes a seal body having a top portion, a central portion, and a bottom portion. There is a first opening in the top portion, a second opening in the bottom portion and a passageway extending between the first and second openings. The first opening is adapted to receive an extension portion of the needle guide and be coupled thereto. The seal may be coupled to the extension portion of the needle guide by a number of different processes including bonding, such as with adhesives, clamping, or by an overmolding process. The extension portion may include at least one groove to enhance the securement of the seal to the needle guide. The second opening is adapted to receive the needle and be coupled thereto. The seal may be coupled to the needle by a number of different processes including bonding or clamping. The needle may include at least one groove to enhance the securement of the seal to the needle. The central portion is located at a greater radial distance from the needle than the top and bottom portions to form an interior cavity between the seal and needle along the central portion. This configuration allows the flexible seal to stretch and compress along the central portion as the needle reciprocates between the open and closed positions.

These and other objects, advantages and features of the invention will become more readily apparent to those of ordinary skill in the art upon review of the following detailed description taken in conjunction with the accompanying drawings.

BRIEF DESCRIPTION OF THE DRAWINGS

The accompanying drawings, which are incorporated in and constitute a part of this specification, illustrate embodiments of the invention and, together with a general description of the invention given above, and the detailed description given below, serve to explain the invention.

DETAILED DESCRIPTION

Figure 1:
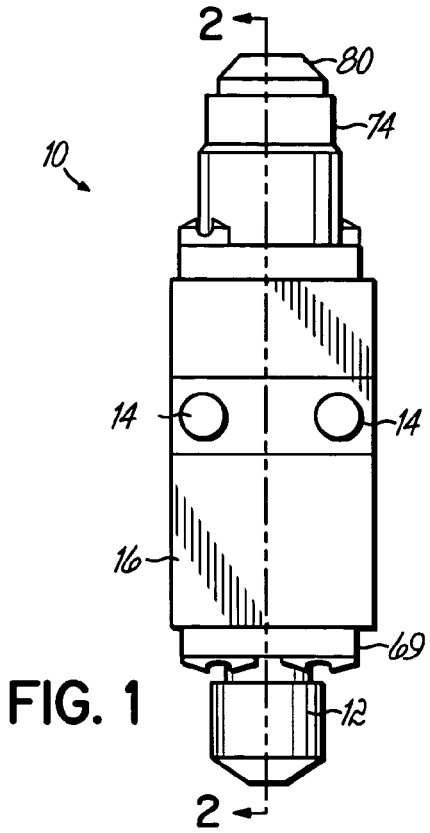
FIG. 1 illustrates an exemplary liquid dispensing module.
Figure 2:
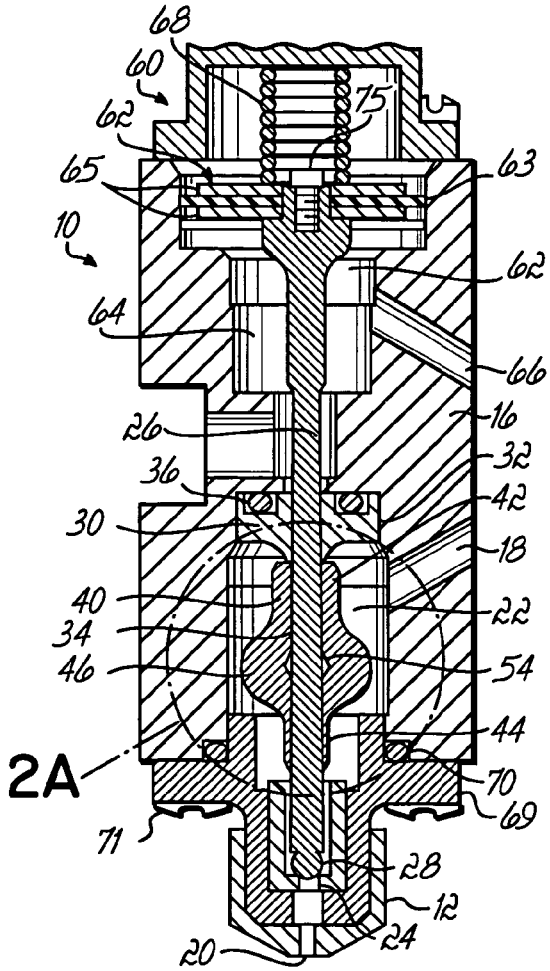
FIG. 2 illustrates a sectional view of an exemplary liquid dispensing module of FIG. 1 having a seal in accordance with the invention.

FIG. 1 depicts an exemplary dispensing module 10 in accordance with the principles of the present invention. The exterior appearance of the module 10 resembles a convention dispensing module in that it includes a dispensing nozzle 12 from which adhesive or other liquid is dispensed and includes bolts, or other fasteners 14 for connecting the module 10 to a gun manifold, or body (not shown). FIG. 2 provides a cutaway view of the module 10 and more clearly shows the needle, seals and other components within the module 10 that operate to dispense liquid from the dispensing nozzle 12 in a controlled manner.

With reference to FIG. 2, the module 10 typically includes a dispenser body 16 having a liquid inlet 18, a discharge outlet 20, and a flow channel 22 between the liquid inlet 18 and the discharge outlet 20 capable of directing a flow of the liquid. The flow channel 22 includes a valve seat 24 near the discharge outlet 20. A valve stem or needle 26 is mounted in dispenser body 16 for reciprocating motion therein. The needle 26 includes a valve element, such as ball 28, that cooperates with valve seat 24 to selectively dispense liquid from module 10. In particular, the needle 26 reciprocates between an open and closed position. In the open position, ball 28 is disengaged from the valve seat 24 so that a gap is formed between the ball 28 and the valve seat 24 that allows liquid to be dispensed from dispensing outlet 20. In the closed position, ball 28 is engaged with the valve seat 24 so as to prevent any liquid from being dispensed from the discharge outlet 20. Movement of the needle 26 between the open and closed position then controls the dispensing of liquid from module 10.

Figure 2A:
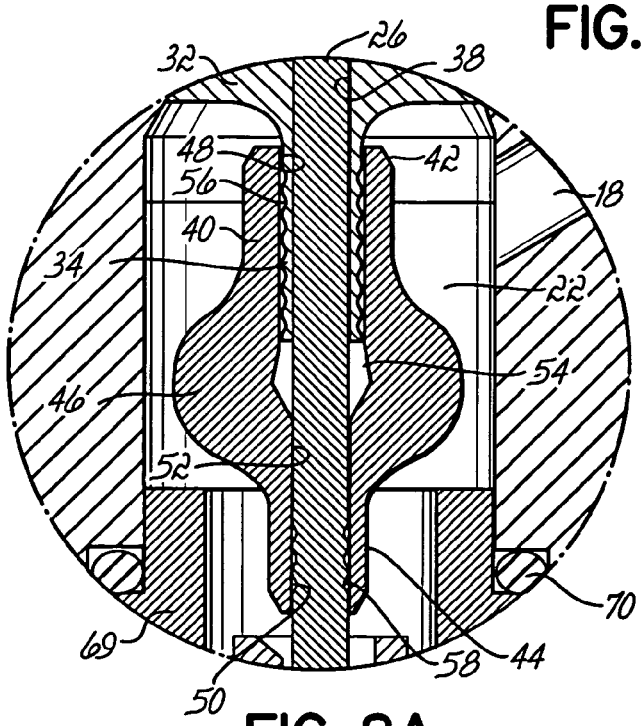
FIG. 2A is an enlarged view of the encircled portion in FIG. 2.

Referring to FIGS. 2 and 2A, the dispensing module 10 further includes a needle guide, generally shown at 30, coupled to the dispenser body 16. The needle guide 30 acts as a guide to keep the needle 26 vertically aligned within the dispenser body 16 so that, for example, the ball 28 and valve seat 24 properly engage in the closed position. The needle guide 30 is generally cylindrical and includes a main body portion 32 and a cylindrical extension portion 34 below the main body portion 32. The needle guide 30 does not move relative to the dispenser body 16 and therefore a static seal, such as o-ring 36, may be used to seal the needle guide 30 from the dispenser body 16 along the main body portion 32. Main body portion 32 and extension portion 34 include a needle passageway 38 adapted to receive a portion of the needle 26 therethrough. The needle 26 moves relative to the needle guide 30 as it reciprocates between the open and closed positions.

Liquid in flow channel 22 is typically under pressure and will undesirably migrate, or leak, out of the flow channel 22 unless a seal is provided. To this end, the present invention includes a flexible seal, generally shown at 40, that flexes with movement of needle 26. The flexible seal 40 includes a seal body having a first end 42, a second end 44, and a central portion 46 between the first and second ends 42, 44. The first and second ends have openings 48, 50, respectively, and the seal body has a passageway 52 extending between the first and second openings 48, 50 so that the needle 26 may pass through the seal 40. The central portion 46 of the seal 40 generally flares radially outward away from needle 26. More specifically, central portion 46 may be bulbous as shown in the illustrative embodiment. Accordingly, an annular cavity 54 is formed between the central portion 46 of the seal 40 and the nearby portion of the needle 26. The flexible seal 40 may be made from any of a variety of available elastomers or plastics, such as, for example, the fluoroelastomer marketed as Viton®.

In an advantageous aspect of the invention, the first end 42 of the seal 40 is coupled to the extension portion 34 of the needle guide 30. The first end 42 may be coupled to the needle guide 30 by chemical bonding, adhesives or mechanical means, such as clamping. One exemplary method uses Pelseal® adhesive to accomplish the coupling. The first end 42 of the seal 40 may also be coupled to extension portion 34 by an overmolding process. To enhance the securement of the seal 40 with the needle guide 30, the extension portion 34 may include at least one circumferential groove 56 therein. The grooves 56 provide surface irregularities that enhance the coupling between the seal 40 and needle guide 30. Moreover, the second end 44 of the seal 40 is coupled to a portion of the needle 26. In this way, as the needle 26 moves between the open and closed positions, the second end 44 of seal 40 moves with the needle 26 so that there is no relative motion between the seal 40 and needle 26 along their contacting portion. In a likewise manner, the second end 44 may be coupled to the needle through chemical bonding, adhesives or clamping. The needle 26 may also include at least one circumferential groove 58 to enhance the securement of the seal 40 to the needle 26. Those having ordinary skill in the art will further recognize other techniques for coupling an elastomer with metal or other hard material and is contemplated within the scope of the present invention.

With the above-described configuration, as needle 26 moves toward the open position, the first and second ends 42, 44 of seal 40 move toward each other thereby compressing the central portion 46 of seal 40. As the needle moves toward the closed position, the first and second ends 42, 44 of seal 40 move away from each other thereby stretching the central portion 46 of seal 40. Accordingly, the seal 40 provides a barrier against liquid within the flow channel 22 from leaking out of flow channel 22 and contaminating the other working parts of module 10. The flexible seal 40 is therefore not a dynamic seal in that it is not positioned between moving surfaces, i.e., the seal and contacting portion of the needle are not moving relative to each other. Consequently, the seal of the invention overcomes the drawbacks associated with conventional dynamic seals used for reciprocating needles.

The flexibility and shape of the seal 40 provides an additional benefit as well. When the needle is moved to the open position, a gap forms between the ball 28 and the valve seat 24 near the discharge outlet 20 of module 10. The pressurized liquid then exerts an upward force on the ball 28 of the needle 26. Advantageously, when in the open position, the seal 40 is compressed along central portion 46. This compression causes a restoring force on the needle 26 in the downward direction. Thus, the forces act in opposed directions and as such counteract each other to help hydraulically balance the needle 26. This benefit allows for quicker response when opening and closing the dispensing module, i.e., engaging/disengaging the ball 28 from valve seat 24 during dispensing operations.

The dispensing module 10 includes an actuator, generally shown at 60, operatively coupled to needle 26 and capable of actuating the needle 26 between the open and closed positions so as to selectively dispense liquid from discharge outlet 20. In an exemplary embodiment shown in FIG. 2, actuator 60 includes a piston assembly 62 coupled to a top portion of needle 26. Piston assembly 62 generally includes a piston seal 65, such as a Rulon® piston seal, positioned between two washers 65. The piston assembly 62 is located within a pressurized air chamber 64 so that a bottom surface of piston assembly 62 closes off the air chamber 64 and is sealed by piston seal 63. A pressurized air inlet port 66 is connected to the air chamber 64 and capable of pressurizing chamber 64. In this way, when chamber 64 is pressurized, the air exerts a force on the bottom surface of piston assembly 62 that disengages the ball 28 from the valve seat 24 and allows liquid flow from the discharge outlet 20 of module 10. The actuator 60 may further include a spring-return mechanism 68 coupled to needle 26 that urges the ball 28 into engagement with valve seat 24. Thus, when the air chamber 64 is depressurized, the spring-return mechanism 68 applies a downward force to engage ball 28 with valve seat 24. Those having ordinary skill in the art will recognize other configurations for the actuator 60. For instance, instead of the spring-return mechanism 68, a double acting piston with air chambers on both sides of piston assembly 62 may be used. Furthermore, electrical actuators may be used to selectively move the needle between the open and closed positions.

The dispensing module 10 may also include a seat adaptor 69 adjacent the dispensing outlet 20 of module 10. Seat adaptor 69 is typically inserted into the lower end of module body 16 and coupled thereto, such as by fasteners 71, and defines a portion of fluid channel 22 including valve seat 24. Seat adaptor 69 also includes a static o-ring 70 to seal the connection between the seat adaptor 69 and module body 16. The dispensing nozzle 12 is coupled to the terminal end of the seat adaptor 69. The dispensing nozzle 12 controls the size of the dispensing orifice and therefore the amount of liquid dispensed by module 10. Different dispensing nozzles 12 may be attached to module 10, depending on the specific dispensing application.

Figure 3:
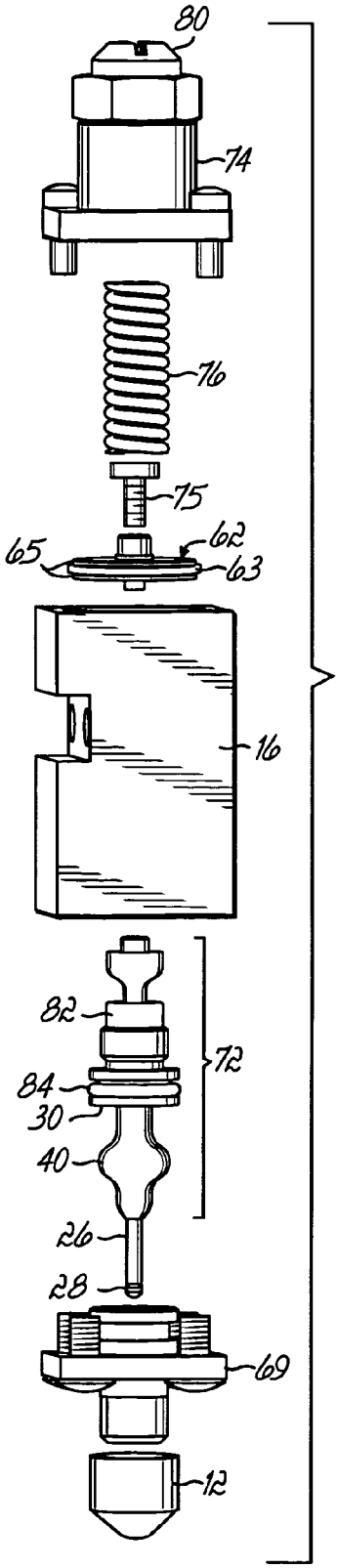
FIG. 3 illustrates an exploded view of the components of the liquid dispensing module of FIG. 1.

FIG. 3 illustrates an exploded view of the major sub-assemblies of a dispensing module 10. As many of these sub-assemblies, except for the flexible seal 40 around the needle 26 are similar to the sub-assemblies found in conventional dispensing modules, they are only briefly described. In general, a module body 16 houses a needle assembly 72, which moves up and down within the module body 16. To this end, a piston cap 74 is included that attaches to the top of the module body 16 and secures a spring 76 that acts on the piston assembly 62. As discussed above, piston assembly 62 includes the piston seal 63 juxtaposed between two washers 65. The piston assembly 62 may be coupled to the top portion of the needle assembly 72, and more particularly, may be coupled to the top portion of needle 26 by a fastener, such as a screw 75. The module body 16 may be constructed of anodized aluminum or similar material. The spring 76 acts on the top surface of the piston assembly 62 to bias the piston assembly 62 downwards to close the dispensing module 10 when insufficient pressurized air is being applied to the bottom surface of piston assembly 62. An adjustable screw 80 is also typically used to adjust the compression rate of the spring 76. The needle assembly 72 (described in detail with respect to FIG. 4) is inserted and housed within the module body 16. The seat adaptor 69 is then inserted and coupled to the lower portion of the module by 16. The dispensing nozzle 12 is then attached to the seat adaptor 69.

Figure 4:
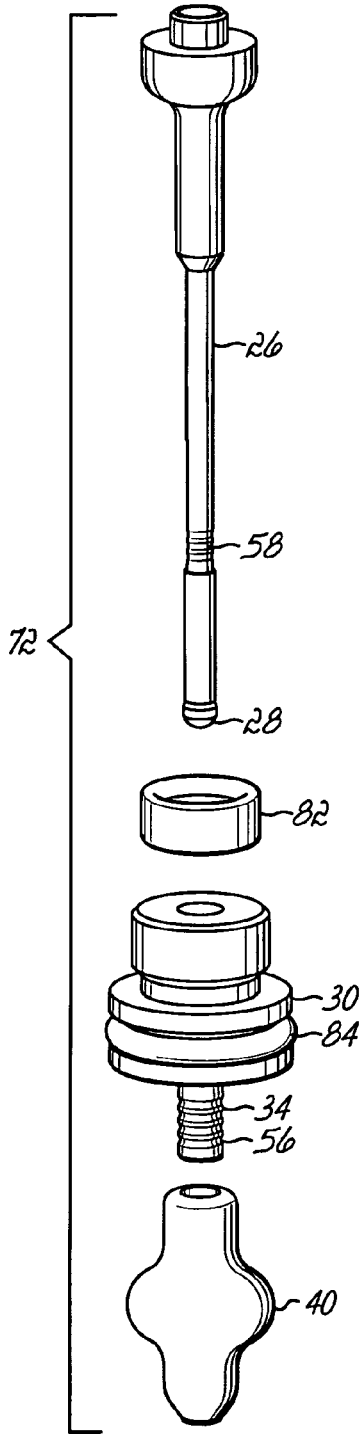
FIG. 4 illustrates an exploded view of an exemplary seal and needle in accordance with the invention.

Turning now to FIG. 4, the needle assembly 72 generally includes the needle 26 having the ball 28 on an end thereof. The lip seal 82 surrounds the needle 26 below the top portion of the needle 26 and provides a seal so that the pressurized air does not escape but, instead, applies force against the bottom surface of the piston assembly 62 when so assembled. Conventional lip seals from a variety of elastomeric materials may be used for this purpose. The lip seal 82 rests on the needle guide 30. The exemplary needle guide 30 of FIG. 4 includes an annular region with a groove for supporting an o-ring 84 and includes an extension portion 34 to which the flexible seal 40 can be coupled. Although not shown in FIG. 4, the bottom of the seal 40 is coupled to a portion of the needle 26 thereby creating a seal that flexes and stretches as the needle 26 slides up and down within and relative to the needle guide 30.

While the present invention has been illustrated by a description of various preferred embodiments and while these embodiments have been described in some detail, it is not the intention of the Applicant to restrict or in any way limit the scope of the appended claims to such detail. Additional advantages and modifications will readily appear to those skilled in the art. The various features of the invention may be used alone or in numerous combinations depending on the needs and preferences of the user.

The invention claimed is:

1. A liquid dispensing module for dispensing a viscous hot melt adhesive comprising:

a dispenser body having a liquid inlet, a discharge outlet, and a flow channel capable of directing a flow of the hot melt adhesive from said liquid inlet to said discharge outlet, said flow channel including a valve seat between said liquid inlet and said discharge outlet;

a needle defining a central axis and having a valve element mounted for reciprocating movement in said dispenser body between an open position in which said valve element is disengaged with said valve seat allowing hot melt adhesive flow from said discharge outlet and a closed position in which said valve element is engaged with said valve seat preventing hot melt adhesive flow from said discharge outlet;

a needle guide mounted to said dispenser body and having a passage for receiving a portion of said needle, said needle adapted to move axially relative to said needle guide;

a flexible seal having first and second opposed ends and a bulbous central portion disposed between said first and second ends, said first end coupled to said needle guide, said second end coupled to said needle and adapted to move with said needle, said central portion located a greater radial distance from said needle axis than said first and second ends to define an unfilled annular cavity between said seal and said needle, and said seal having a thickness along the central portion that is greater than a thickness of the seal along the first and second ends, said seal adapted to prevent hot melt adhesive from leaking out of said flow channel; and an actuator operatively coupled to said needle, said actuator capable of actuating said needle between the open and closed positions to selectively dispense hot melt adhesive from said discharge outlet.

2. The module of claim 1, wherein said actuator further comprises:

a piston coupled with said needle and communicating with a pressurized air inlet port for moving said valve element out of engagement with said valve seat.

3. The module of claim 1, wherein said actuator further comprises:

a spring-return mechanism coupled with said needle for urging said valve element into engagement with said valve seat.

4. The module of claim 1, wherein said seal is made from a fluoroelastomer.

5. The module of claim 1, wherein said needle guide includes a cylindrical extension portion, said first end of said seal coupled to said extension portion.

6. The module of claim 5, wherein said extension portion includes at least one groove formed therein, said groove adapted to enhance the securement of the seal to the extension portion.

7. The module of claim 1, wherein said needle includes at least one groove formed in a portion interfacing with said second end of said seal, said groove adapted to enhance the securement of the seal to the needle.

8. The module of claim 1, wherein said first end of said seal is integrally molded to said needle guide.

9. The module of claim 1, wherein the seal generates a restoring force on the needle when in the open position that opposes the force of a pressurized fluid on the needle to hydraulically balance the needle.

10. The module of claim 1, wherein said seal includes a single bulbous portion.

11. A method for sealing a reciprocating needle in a hot melt adhesive dispensing module, comprising:

arranging the reciprocating needle within a needle guide such that the reciprocating needle moves axially relative thereto along a central axis;

rigidly securing a first end of an annular seal to the needle guide and a second end of the seal to the needle, the seal having a bulbous central portion located a greater radial distance from the central axis than the first and second ends to define an unfilled annular cavity between the seal and the needle, and the seal having a thickness along the central portion that is greater than a thickness of the seal along the first and second ends; and reciprocating the needle relative to the needle guide.

12. The method of 11, wherein the reciprocating needle moves between an open position, allowing hot melt adhesive flow from the module, and a closed position, preventing hot melt adhesive flow from the module, the method further comprising:

compressing the seal along the central portion when the needle moves toward the open position; and stretching the seal along the central portion when the needle moves toward the closed position.

13. The method of claim 11, further comprising:

generating a restoring force on the needle using the seal, the restoring force opposing a force on the needle from a pressurized fluid to hydraulically balance the needle.

14. The method of claim 11, wherein the seal includes a single bulbous portion.

15. An assembly for use in a hot melt adhesive dispensing module for dispensing a viscous hot melt adhesive comprising:

a needle defining a central axis and having a valve element adapted for reciprocating movement in the dispensing module between an open position and a closed position;

a needle guide adapted for mounting within the dispensing module and having a passage for receiving a portion of said needle, said needle adapted to move axially relative to said needle guide; and a flexible seal having first and second opposed ends and a bulbous central portion disposed between said first and second ends, said first end coupled to said needle guide, said second end coupled to said needle and adapted to move with said needle, said central portion located a greater radial distance from said needle axis than said first and second ends to define an unfilled annular cavity between said seal and said needle, and the seal having a thickness along the central portion that is greater than a thickness of the seal along the first and second ends.

16. The assembly of claim 15, wherein said seal is made from a fluoroelastomer.

17. The assembly of claim 15, wherein said needle includes at least one groove formed in a portion interfacing with said second end of said seal, said groove adapted to enhance the securement of said seal to said needle.

18. The assembly of claim 15, wherein said first end of said seal is integrally molded to said needle guide.

19. The assembly of claim 15, wherein the seal is adapted to generate a restoring force on the needle when in the open position that opposes a force of a pressurized fluid on the needle to hydraulically balance the needle.

20. The assembly of claim 15, wherein said seal includes a single bulbous portion.

* * * * *

UNITED STATES PATENT AND TRADEMARK OFFICE

CERTIFICATE OF CORRECTION

PATENT NO. : 7,617,955 B2
APPLICATION NO. : 10/975229
DATED : November 17, 2009
INVENTOR(S) : John M. Riney It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 891 days.

Signed and Sealed this

Nineteenth Day of October, 2010

David J. Kappos

David J. Kappos
*Director of the United States Patent and Trademark Office*